US005195545A

United States Patent [19]

Thibodeaux

[11] Patent Number: 5,195,545

[45] Date of Patent: Mar. 23, 1993

[54] HAIR RELAXANT APPLICATOR APPARATUS

[76] Inventor: Gregory W. Thibodeaux, 561 N. Jefferson, Apt. 1, Memphis, Tenn. 38103

[21] Appl. No.: 874,537

[22] Filed: Apr. 27, 1992

[51] Int. Cl.[5] ..... A45D 24/22

[52] U.S. Cl. ..... 132/116; 132/112; 132/212; 401/150

[58] Field of Search ..... 132/112, 113, 114, 115, 132/116, 212, 272; 401/146, 150

[56] References Cited

U.S. PATENT DOCUMENTS

| | | | |
|---|---|---|---|
| 1,638,523 | 8/1927 | Burgewitz | 132/112 |
| 2,171,725 | 9/1939 | Hambrick, Jr. | 132/113 |
| 3,429,642 | 2/1969 | Underwood | 401/16 |
| 4,306,671 | 12/1981 | Fisher | 222/326 |
| 4,309,119 | 1/1982 | Wittersham | 132/112 |
| 4,323,085 | 4/1982 | Rohm | 132/113 |
| 4,376,441 | 3/1983 | Duncan | 132/9 |
| 4,592,376 | 6/1986 | Sigmund et al. | 132/112 |
| 5,027,984 | 7/1991 | Gakhar et al. | 222/326 |

FOREIGN PATENT DOCUMENTS

| | | | |
|---|---|---|---|
| 822718 | 11/1951 | Fed. Rep. of Germany | 132/212 |
| 2830480 | 1/1980 | Fed. Rep. of Germany | 132/212 |

*Primary Examiner*—Gene Mancene
*Assistant Examiner*—Frank A. LaViola
*Attorney, Agent, or Firm*—Walker, McKenzie & Walker

[57] ABSTRACT

A hair relaxant applicator apparatus for applying a controlled flow of hair relaxant to a person's hair. The apparatus includes a supply unit and an applicator brush interconnected by tubing. The supply unit has a plastic supply container, a reciprocating piston and rod within a bore thereof, and an electric motor that moves the piston rod using reduction gearing. A footswitch and rheostat control the direction and speed of the motor by interconnection with its power supply. The piston extrudes hair relaxant from the supply container, through the tubing, through a passageway within the brush, and out openings in the head of the brush at the base of bristles. The brush has a handgrip with a thumbrest, a pointed tip for parting hair, and a longitudinal ridge for smoothing the applied relaxant. A cap on the supply container may be removed for filling and cleaning the container, and a replacement cap and plug prevent dripping of the hair relaxant when the tubing is separated from the supply container.

3 Claims, 1 Drawing Sheet

HAIR RELAXANT APPLICATOR APPARATUS

BACKGROUND OF THE INVENTION

1. Field of the Invention

The present invention relates, in general, to cosmetological equipment, and in particular, to hair relaxant applicators.

2. Information Disclosure Statement

Cosmetologists frequently apply a hair relaxant treatment to a client's hair in order to permanently rearrange the basic structure of over-curly hair into a straight form. In the trade, the terms "chemical hair relaxing" and "chemical hair straightening" are used interchangeably to refer to the process of permanently removing waves or curls from human hair. Heretofore, a bucket of hair relaxant would be prepared and placed near the client at a treatment station, and the cosmetologist would either dip a comb in the prepared hair relaxant solution or similarly use a brush and finger method to obtain a quantity of the relaxant solution, then apply the extremely viscous solution to the client's hair. Such an imprecise method of application frequently applies too much hair relaxant, thereby causing waste and expense, and does not produce a uniform application of the hair relaxant, thereby producing damaging results.

Also, as a client's hair grows, the cosmetologist must treat the new growth of hair by applying relaxant only to this new growth in a "retouch" treatment, typically every six to eight weeks. Using heretofore known methods, such as the comb or brush and finger methods, to perform the retouch application of hair relaxant, it is almost impossible to avoid overlapping retreatment of previously treated hair, thus causing overprocessing of that hair.

Furthermore, hair relaxant solution is extremely caustic, typically being a prepared mixture of sodium hydroxide, and must be applied only for a period of carefully timed duration, typically fifteen minutes, before the treated hair must be neutralized. Because of the very high alkaline content of sodium hydroxide, extreme care must be exercised in its use. Prior methods of hair treatment are very time consuming, as they require frequent trips to a supply bucket of hair relaxant for scooping or dipping onto a comb or brush, and therefore cause those sections of the scalp treated last to not have had the same duration of treatment as those sections treated first when the neutralizer is applied. Additionally, the carrying of caustic hair relaxant from a supply bucket to the head of a client frequently permits some hair relaxant to fall onto the client's face or eyes, thereby potentially causing injury.

It is therefore desirable to have a hand-held hair relaxant applicator apparatus for applying a controlled flow of hair relaxant to a person's hair. Such an apparatus should be resistant to the caustic and corrosive properties of the hair relaxant solution, and be able to permit the rapid and even application of the extremely viscous hair relaxant solution to the person's hair while maintaining precise control of the application of the hair relaxant, thereby providing a substantially uniform treatment, both in duration and in amount, to the hair.

A preliminary patentability search in Class 132, subclasses 112 through 114; Class 401, subclasses 118, 119, 150, and 176 through 179; and Class 222, subclass 326, produced the following patents, some of which may be relevant to the present invention: Underwood, U.S. Pat. No. 3,429,642, issued Feb. 25, 1969; Fisher, U.S. Pat. No. 4,306,671, issued Dec. 22, 1981; Duncan, U.S. Pat. No. 4,376,441, issued Mar. 15, 1983; Sigmund et al., U.S. Pat. No. 4,592,376, issued Jun. 3, 1986; and Gakhar et al., U.S. Pat. No. 5,027,984, issued Jul. 2, 1991.

While each of the above patents disclose various hinging apparatus or interlocking hanging systems, none disclose or suggest the present invention. More specifically, none of the above patents disclose or suggest a hair relaxant applicator apparatus for applying a controlled flow of hair relaxant to a person's hair, said apparatus comprising a supply unit, said supply unit comprising: a tubular supply container having a longitudinal bore therethrough, said bore terminating in an opening through a first end of said supply container and terminating in a mouth through a second end of said supply container; a piston slidingly and sealingly engaging said longitudinal bore, said piston being longitudinally reciprocable within said bore; a piston rod having a first and a second end, said piston rod being attached at said first end of said piston rod to said piston and with said second end of said piston rod reciprocatingly extending out of said bore through said mouth of said supply container; an electric motor having a rotating shaft; power supply means for supplying a source of power to said motor; and gearing means for translating the rotation of said shaft of said electric motor into reciprocating motion of said piston rod through said longitudinal bore; said apparatus further comprising an applicator brush remote from said supply unit, said applicator brush having a passageway therein and further having an orifice in communication with said passageway, said applicator brush comprising: a head portion, said head portion having a plurality of bristles extending outwardly from an outer surface of said head portion, and further having a plurality of openings through said outer surface adjacent said bristles, said openings being in communication with said passageway; and a handgrip portion adjacent said head portion for holding by an operator; and, said apparatus still further comprising tubing means for piping said hair relaxant from said opening through said first end of said supply container to said orifice of said applicator brush.

Underwood, U.S. Pat. No. 3,429,642, describes a hair treatment applicator having a brush with a passageway therein having openings thereto at the base of bristles in the brush. A piston, moved by pressurized inert gas, forces treatment liquid from a remote reservoir through tubing to the passageway of the brush. Unlike the present invention, which uses a motor-driven piston and gearing means, the Underwood device uses pressurized inert gas to drive the piston, thereby giving a lesser degree of control over the flow of the treatment liquid than does the present invention.

Fisher, U.S. Pat. No. 4,306,671, describes a caulking gun dispenser having a motor-powered, gear-driven plunger driven by a cordless motorized screwdriver. Similarly, Gakhar et al., U.S. Pat. No. 5,027,984, describes a motor-driven caulking gun attachment having a threaded pusher rod that is reciprocated by a gear-reducer. Unlike the present invention, both devices use a cartridge for holding the caulking to be extruded, not hair relaxant, and neither has an applicator brush for applying the hair relaxant. As a further distinction, the plunger or pusher of neither device sealingly engages the walls of the caulking cartridge.

Duncan, U.S. Pat. No. 4,376,441, describes a hair treatment applicator in which a remote heater/blower unit forces heated air into a chamber within a hand-held applicator to melt viscous hair treatment preparations therein and cause them to flow through openings in the applicator. The present invention does not use forced heated air, and avoids heating the hair relaxant which should not be applied hot or warm.

Sigmund et al., U.S. Pat. No. 4,592,376, describes a hand-held hair dye applicating apparatus having a slot-shaped nozzle surrounding a plurality of bristles through which hair dye liquid emerges, as well as a hair-separating tip. A fourth embodiment, shown in FIGS. 9–11, describes a telescoping piston rod with threaded sections that is caused to telescope by an electric motor within the hand-held apparatus. In contrast, while the present invention also uses an electric motor, the motor is remote from the applicator brush in a supply unit that is connected to the applicator brush by tubing, and the motor does not drive a telescoping piston rod.

SUMMARY OF THE INVENTION

The present invention is a hair relaxant applicator apparatus comprising a supply unit, an applicator brush, and tubing connecting the supply unit to the applicator brush for piping hair relaxant therebetween. The applicator brush has a bristled head with a plurality of openings at the base of the bristles through which the hair relaxant emerges. The supply unit includes an electric motor and gear reduction that drive a piston through a tubular supply container to extrude hair relaxant therefrom through the tubing.

It is an object of the present invention to provide a simple hair relaxant applicator that applies a controlled flow of hair relaxant to a client's hair evenly and quickly, thereby reducing the risk of damaging the client's hair as frequently occurs with prior methods, and that reduces the risk of dropping caustic hair relaxant on the face or in the eyes of the client. The applicator should be easily disassembled for cleaning, and substantially impervious to the caustic and corrosive properties of hair relaxant. It is a further object that convenient means be provided for parting the client's hair while using the applicator and for smoothing the client's hair during or after applying the hair relaxant.

DESCRIPTION OF THE PREFERRED EMBODIMENT

Figures 1, 2, 3, 4, 5:
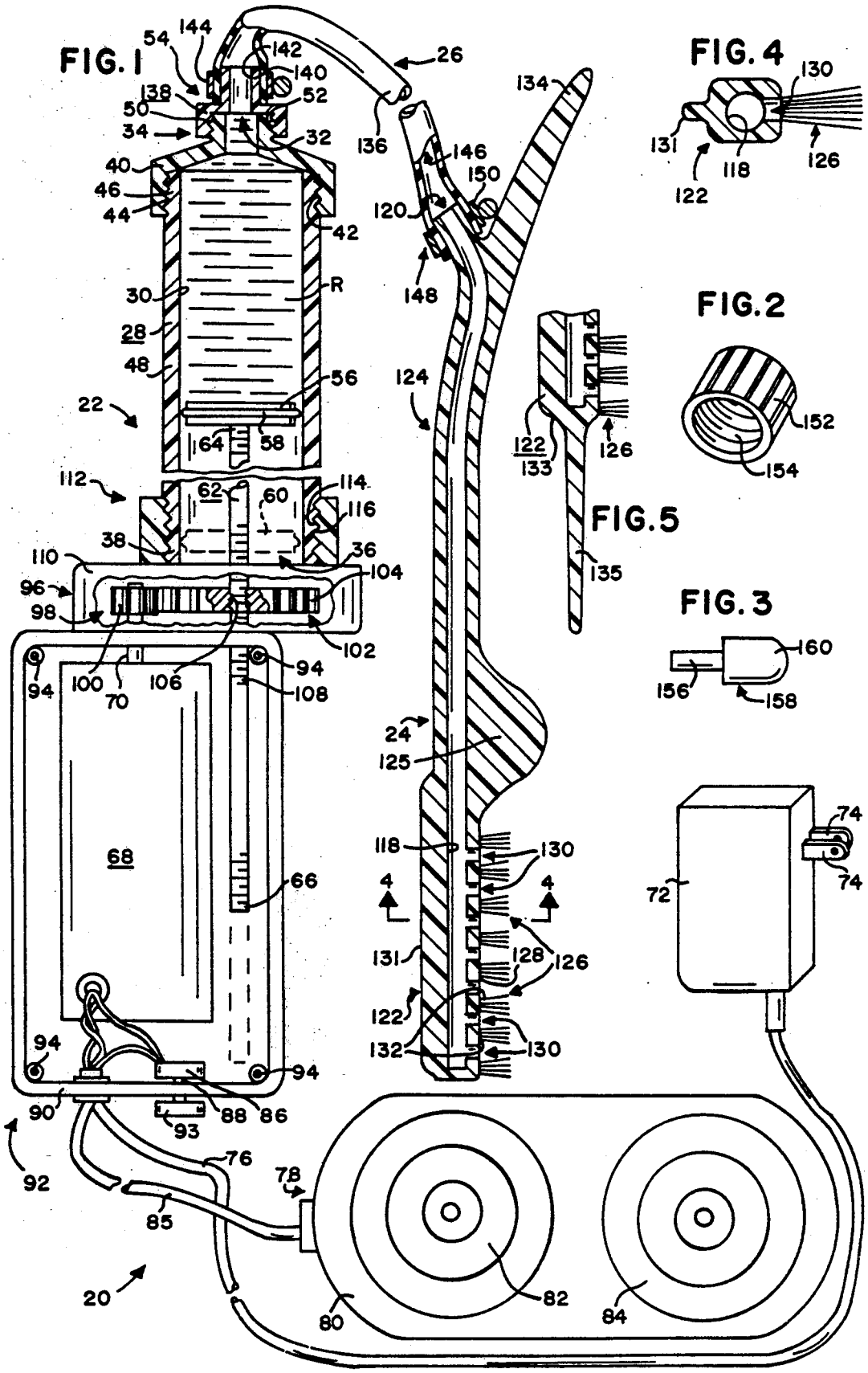
FIG. 1 is a partially sectioned view of the present invention showing the various parts.
FIG. 2 is a perspective view of the cap of the present invention for the relaxant bottle.
FIG. 3 is a view of the plug of the present invention for the flexible tubing.
FIG. 4 is a transverse sectional view of the applicator brush, taken substantially along the line 4—4 shown in FIG. 1.
FIG. 5 is a partial sectional view of an alternate embodiment of the present invention showing the pointed tip extending from the head portion of the applicator brush.

Referring to FIG. 1, the hair relaxant applicator apparatus 20 for applying a controlled flow of hair relaxant to a person's hair is seen to comprise a supply unit 22, an applicator brush 24 remote from supply unit 22, and tubing means 26 for piping hair relaxant therebetween in a manner hereinafter described.

Supply unit 22 comprises a tubular supply container 28 having a longitudinal bore 30 therethrough containing a volume of hair relaxant R therein. Bore 30 terminates in an opening 32 through a first end 34 of supply container 28, and also terminates in a mouth 36 through a second end 38 of supply container 28. Preferably, first end 34 includes a cap 40 having internal threads 42 that threadedly and sealingly engage external threads 44 at end 46 of body 48 of supply container 28. Adjacent opening 32 at first end 34 of supply container 28 are external threads 50 that threadedly and sealingly engage internal threads 52 of first end 54 of tubing means 26, it being understood that internal threads 52 are adapted for threaded engagement with external threads 50. It will now be understood that cap 40 may be easily unthreaded from body 48 for filling supply container 28 with hair relaxant, as well as for cleaning.

Supply unit 22 further comprises a piston 56 slidingly and sealingly engaging bore 30, preferably by peripheral rubber O-ring 58 received in a circumferential channel, not shown, about piston 56. As is the case with all of the parts of supply container 28 which contact hair relaxant R, piston 56 is non-metallic, and preferably plastic, to prevent corrosion by hair relaxant R. Piston 56 is seen to be longitudinally reciprocable within bore 30, moving from a fully retracted position 60 to positions progressively into bore 30, thereby reducing the volume within supply container 28 for hair relaxant R and consequently extruding hair relaxant R through opening 32 in a manner that will now be apparent.

Axially aligned within bore 30 is a piston rod 62 having a first and a second end, 64 and 66, respectively, with first end 64 being axially attached to piston 56 and with second end 66 reciprocatingly extending out of bore 30 through mouth 36, thereby providing for longitudinally reciprocating movement of piston 58 as piston rod 62 is extended into and withdrawn from bore 30 in a manner hereinafter described.

Supply unit 22 further includes a well-known reversible electric motor 68 having a rotating shaft 70, and power supply means 72 for supplying a source of power to motor 68 as from a well-known electric wall outlet through prongs 74. Power supply means 72 is interconnected with motor 68 as by wires 76 in a manner well-known to those skilled in the art. Preferably, supply unit 22 includes switch means 78, such as footswitch 80 having forward and reverse pedal switches 82 and 84, respectively, interposed between power supply means 72 and motor 68 in a manner also well known to those skilled in the art as with wires 85, for selectively causing motor 68 to rotate shaft 70 in either a clockwise or a counterclockwise direction. Supply unit 22 also preferably includes rheostat means 86, well-known to those skilled in the art and interposed between power supply means 72 and motor 68 in a manner also well-known to those skilled in the art, for varying the speed at which motor 68 rotates shaft 70. Rheostat means 86 has a shaft 88 extending through wall 90 of enclosure 92 within which motor 68 is mounted, and may have a knob 93 secured to shaft 88 for turning by the cosmetologist to vary the speed at which motor 68 rotates shaft 70, in a manner that will now be apparent.

Enclosure 92 is shown with its cover removed, and a cover, not shown, may be secured to enclosure 92 in a manner well-known to those skilled in the art, as by screws, through the cover, threadedly received into tapped holes 94 of enclosure 92.

Supply unit 22 further includes gearing means 96, secured to enclosure 92, for translating the rotation of motor shaft 70 into reciprocating motion of piston rod 62 into and out of bore 30. Gearing means 96 preferably includes a smaller gear 98 having teeth 100 and axially secured to motor shaft 70 for turning thereby, and further includes a larger gear 102 having teeth 104 in meshing engagement with teeth 100 of smaller gear 98. Larger gear 102 also has an internally threaded hub 106 through which piston rod 62 axially extends, with external threads 108 of piston rod 62 being in threaded engagement with internally threaded hub 106. It will now be understood that as motor shaft 70 rotates, thereby rotating smaller gear 98 in one direction, larger gear 102 will be rotated in the opposite direction, thereby causing internally threaded hub 106 to screwingly interact with external threads 108 of piston rod 62 and causing rod 62, along with piston 56, to reciprocate within bore 30. The relative gear ratio between gears 98 and 102, as well as the pitch of threads 66 and 106, can be selected, in a manner well-known to those skilled in the art, to appropriately translate the torque of motor 68 into the slow controlled reciprocating movement of piston 56. The cosmetologist can vary the speed of motor 68 using knob 93 for a faster or slower extrusion of hair relaxant R from supply unit 22 to applicator brush 24 when forward footswitch 82 is depressed, or can retract piston 56 within supply container 28 for refilling and/or cleaning thereof by depressing reverse footswitch 84, in a manner that will now be apparent.

Gearing means 96 preferably is covered by a housing 110 secured to enclosure 92, with housing 110 having a docking receptacle 112 with internal threads 114 adapted for sealing threaded engagement with external threads 116 at second end 38 of supply container 28. It shall be understood that, by unscrewing supply container 28 from docking receptacle 112, supply container 28 may be filled with hair relaxant R or cleaned, as required, by the cosmetologist.

As previously noted, apparatus 20 further comprises applicator brush 24 which in turn has a passageway 118 therein and an orifice 120 in communication with passageway 118. Applicator brush 24 includes a head portion 122 as well as a handgrip portion 124 adjacent head portion 122 for holding by an operator in his or her hand in the usual manner. Brush 24 may also include a thumbrest 125 where handgrip portion 124 meets head portion 122, and may have an external shape not unlike a well-known hairbrush. Head portion 122 has a plurality of resilient bristles 126, extending outwardly from an outer surface 128 of head portion 122, and further has a plurality of openings 130 through outer surface 128 and in communication with passageway 118, adjacent the base 132 of bristles 126. Head portion 122 may also include a longitudinal ridge 131, remote from bristles 126 and extending outwardly from head portion 122 as seen in FIGS. 1 and 4, for smoothing the relaxant previously applied to the client's hair. It will be understood that, by rotating applicator brush 24, a cosmetologist can either cause bristles 126 to be positioned for contact with the client's hair, or, alternatively, cause ridge 131 to be similarly positioned.

Applicator brush 24 preferably includes a pointed tip 134 extending outwardly from handgrip portion 124 remote from head portion 122, for use by the cosmetologist in parting the hair of the client upon whom the hair relaxant treatment is being performed. Alternatively, or even concurrently, an alternate embodiment of applicator brush 24 may have a pointed tip 135 extending outwardly from end 133 of head portion 122 remote from handgrip portion 124 as shown in FIG. 5. As with supply container 28, all parts of applicator brush 24 should be non-metallic, preferably plastic or nylon, to prevent corrosion by hair relaxant R.

Finally, apparatus 20 includes tubing means 26, preferably flexible rubber hose 136, for piping hair relaxant R from opening 32 through first end 34 of supply container 28 to orifice 120 of applicator brush 24. First end 54 of tubing means 26 is preferably an internally threaded cap 138 having internal threads 52 adapted for sealing threaded engagement with external threads 50 of supply container 20. Cap 138 has a fitting 140 with a passageway 142 therethrough, and hose 136 is sealingly attached, as by hose clamp 144, to fitting 140 in a manner that will now be apparent, allowing inner diameter passageway 146 through hose 136 to be in communication with opening 32 and bore 30. Similarly, second end 148 of tubing means 26 is sealingly attached to orifice 120 as by hose clamp 150, which, like hose clamp 144, is well known to those skilled in the art.

Referring to FIGS. 2 and 3, when cap 138 is removed from supply container 28, as for cleaning or for replacement of tubing means 26 and brush 24, replacement cap 152, having internal threads 154 adapted for sealing threaded engagement with external threads 50, may be used to seal opening 32, in a manner that will now be apparent, thereby preventing hair relaxant R from dripping from supply container 28. Similarly, when cap 138 is removed, finger 156 of plug 158 may be inserted into passageway 142 for plugging thereof. For convenience, plug 158 may have a gripping portion 160 molded onto an end of finger 156. Again, as with the other parts of apparatus 20 that may come into contact with hair relaxant R, plug 158 should be non-metallic and preferably plastic.

It shall be understood that supply unit may be secured to a tripod for placement near the hair treatment station, or, alternatively, may be mounted on a nearby wall, in a manner well-known to those skilled in the art as by screws or brackets.

Although the present invention has been described and illustrated with respect to a preferred embodiment and a preferred use therefor, it is not to be so limited since modifications and changes can be made therein which are within the full intended scope of the invention. It should also be understood that the various internally and externally mating threaded portions of the invention may be readily and equivalently interchanged, with portions that are shown as being internally threaded becoming externally threaded, and with portions that are shown as being externally threaded becoming internally threaded, for similar threaded mating engagement as before in a manner well-known to those skilled in the art.

I claim:

1. A hair relaxant applicator apparatus for applying a controlled flow of hair relaxant to a person's hair, said apparatus comprising:

(a) a supply unit, said supply unit comprising:

i. a tubular supply container having a longitudinal bore therethrough, said bore terminating in an opening through a first end of said supply container and terminating in a mouth through a second end of said supply container;

ii. a piston slidingly and sealingly engaging said longitudinal bore, said piston being longitudinally reciprocable within said bore;

iii. a piston rod having a first and a second end, said piston rod being attached at said first end of said piston rod to said piston and with said second end of said piston rod reciprocatingly extending out of said bore through said mouth of said supply container;

iv. an electric motor having a rotating shaft;

v. power supply means for supplying a source of power to said motor;

vi. switch means, interposed between said power supply means and said electric motor, for selectively causing said electric motor to rotate said shaft in either a clockwise or a counterclockwise direction, said switch means including a footswitch having a forward and a reverse switch;

vii. gearing means for translating the rotation of said shaft of said electric motor into reciprocating motion of said piston rod through said longitudinal bore; and viii. rheostat means for varying the speed at which said electric motor rotates said shaft;

(b) an applicator brush remote from said supply unit, said applicator brush having a passageway therein and further having an orifice in communication with said passageway, said applicator brush comprising:

i. a head portion, said head portion having a plurality of bristles extending outwardly from an outer surface of said head portion, and further having a plurality of openings through said outer surface adjacent said bristles, said openings being in communication with said passageway; and ii. a handgrip portion adjacent said head portion for holding by an operator; and (c) tubing means for piping said hair relaxant from said opening through said first end of said supply container to said orifice of said applicator brush.

2. A hair relaxant applicator apparatus for applying a controlled flow of hair relaxant to a person's hair, said apparatus comprising:

(a) a supply unit, said supply unit comprising:

i. a tubular supply container having a longitudinal bore therethrough, said bore terminating in an opening through a first end of said supply container and terminating in a mouth through a second end of said supply container, said supply container having external threads at both said first and said second ends;

ii. a piston slidingly and sealingly engaging said longitudinal bore, said piston being longitudinally reciprocable within said bore;

iii. a piston rod having a first and a second end, said piston rod being attached at said first end of said piston rod to said piston and with said second end of said piston rod reciprocatingly extending out of said bore through said mouth of said supply container;

iv. an electric motor having a rotating shaft;

v. power supply means for supplying a source of power to said motor; and vi. gearing means for translating the rotation of said shaft of said electric motor into reciprocating motion of said piston rod through said longitudinal bore, said gearing means including a docking receptacle having internal threads adapted for threaded engagement with said external threads at said second end of said supply container;

(b) an applicator brush remote from said supply unit, said applicator brush having a passageway therein and further having an orifice in communication with said passageway, said applicator brush comprising:

i. a head portion, said head portion having a plurality of bristles extending outwardly from an outer surface of said head portion, and further having a plurality of openings through said outer surface adjacent said bristles, said openings being in communication with said passageway; and ii. a handgrip portion adjacent said head portion for holding by an operator; and (c) tubing means for piping said hair relaxant from said opening through said first end of said supply container to said orifice of said applicator brush, said tubing means including a first end having internal threads adapted for threaded engagement with said external threads at said first end of said supply container.

3. A hair relaxant applicator apparatus for applying a controlled flow of hair relaxant to a person's hair, said apparatus comprising:

(a) a supply unit, said supply unit comprising:

i. a tubular supply container having a longitudinal bore therethrough, said bore terminating in an opening through a first end of said supply container and terminating in a mouth through a second end of said supply container; said supply container including external threads at both said first and said second ends;

ii. a piston slidingly and sealingly engaging said longitudinal bore, said piston being longitudinally reciprocable within said bore and including peripheral O-ring means for sealingly engaging said piston with said longitudinal bore;

iii. a piston rod including external threads and having a first and a second end, said piston rod being attached at said first end of said piston rod to said piston and with said second end of said piston rod reciprocatingly extending out of said bore through said mouth of said supply container;

iv. an electric motor having a rotating shaft;

v. power supply means for supplying a source of power to said motor;

vi. footswitch means, having a forward and a reverse switch and interposed between said power supply means and said electric motor, for selectively causing said electric motor to rotate said shaft in either a clockwise or a counterclockwise direction;

vii. gearing means for translating the rotation of said shaft of said electric motor into reciprocating motion of said piston rod through said longitudinal bore, said gearing means including:

(1) a docking receptacle having internal threads adapted for threaded engagement with said external threads at said second end of said supply container;

(2) a smaller gear axially attached to said shaft of said electric motor; and (3) a larger gear having an internally-threaded hub in threaded engagement with said external threads of said piston rod, said larger gear further being in meshing engagement with said smaller gear;

(b) an applicator brush remote from said supply unit, said applicator brush having a passageway therein and further having an orifice in communication with said passageway, said applicator brush comprising:

i. a head portion, said head portion having a plurality of bristles extending outwardly from an outer surface of said head portion, and further having a plurality of openings through said outer surface adjacent said bristles, said openings being in communication with said passageway;

ii. a handgrip portion adjacent said head portion for holding by an operator;

iii. a pointed tip extending outwardly from an end of said head portion remote from said handgrip portion; and iv. a longitudinal ridge extending outwardly from said head portion remote from said bristles; and (c) tubing means for piping said hair relaxant from said opening through said first end of said supply container to said orifice of said applicator brush, said tubing means including a first end having internal threads adapted for threaded engagement with said external threads at said first end of said supply container.

* * * * *